US008461446B1

(12) United States Patent
Gibson

(10) Patent No.: US 8,461,446 B1
(45) Date of Patent: Jun. 11, 2013

(54) FOOT OPERATED CONTROL DEVICE FOR ELECTRONIC DRUMS

(76) Inventor: Jarod Alexander Gibson, Toronto (CA)

( * ) Notice: Subject to any disclaimer, the term of this patent is extended or adjusted under 35 U.S.C. 154(b) by 0 days.

(21) Appl. No.: 13/343,650

(22) Filed: Jan. 4, 2012

(51) Int. Cl.
*G10H 1/32* (2006.01)
*G10H 3/00* (2006.01)

(52) U.S. Cl.
USPC ..... 84/746

(58) Field of Classification Search
USPC ..... 84/746, 724, 730
See application file for complete search history.

(56) References Cited

U.S. PATENT DOCUMENTS 4,394,830 A * 7/1983 Damiano ..... 84/726
4,501,186 A * 2/1985 Ikuma ..... 84/726
4,753,146 A 6/1988 Seiler
4,854,210 A * 8/1989 Palazzolo ..... 84/726
5,012,716 A * 5/1991 Pagelli ..... 84/727
5,438,158 A * 8/1995 Riboloff ..... 84/727
5,614,688 A * 3/1997 Donnell ..... 84/743
5,714,706 A * 2/1998 Nakada et al. ..... 84/730
5,883,322 A * 3/1999 Baker ..... 84/453
6,043,422 A * 3/2000 Chapman ..... 84/723
6,441,293 B1 * 8/2002 LaBarbera ..... 84/723
7,015,390 B1 * 3/2006 Rogers ..... 84/723
7,019,206 B2 * 3/2006 Mishima ..... 84/723
7,851,684 B1 * 12/2010 Anderson et al. ..... 84/297 R
8,106,283 B2 * 1/2012 Nishitani et al. ..... 84/612
2001/0015123 A1 * 8/2001 Nishitani et al. ..... 84/615

OTHER PUBLICATIONS

Canadian Office Action regarding 2,762,910 dated Feb. 28, 2012.

* cited by examiner

*Primary Examiner* — Jeffrey Donels

(57) ABSTRACT

This invention provides a unique foot operated control device for triggering synthesized sounds from an electronic drum module or any other sound generating module.

5 Claims, 1 Drawing Sheet

FOOT OPERATED CONTROL DEVICE FOR ELECTRONIC DRUMS

FIELD OF THE INVENTION

The present invention relates to the playing of electronic musical instruments and is specifically: an improved, unique, portable, wearable, foot operated control device for use with electronic drum modules or any electronic sound producing device that uses external triggers.

BACKGROUND OF THE INVENTION

The bass drum is at the heart of nearly every drum kit. In order to produce a sound from a bass drum a player needs two distinct apparatuses: the striking apparatus (foot pedal) and sounding apparatus (acoustic bass drum) or trigger apparatus (electronic bass drum).

With an acoustic bass drum, a drum pedal is depressed causing a beater to pivot around an axis and forcibly strike a tensioned skin. This produces a vibration that is then amplified and projected by the hollow chamber of the drum that the skin is attached to. Electronic bass drums function in the same way except that the beater strikes a trigger apparatus instead of a sounding apparatus. This strike is converted by a transducer into an electrical impulse that is sent to an electronic drum module that will then reproduce any synthesized bass drum sound chosen by the player. This sound is then amplified electronically and projected by a loudspeaker.

Acoustic bass drums come in many forms yet they all share a few universal disadvantageous traits: they are large, heavy, not easy to transport, require the continual maintenance of at least one tensioned skin, require a striking apparatus to produce a sound and generally produce only 1 sound.

Electronic bass drums solve a few of these problems. They are smaller, lighter, easier to transport, and can produce a variety of sounds, however some maintenance of a tensioned skin or mesh and the use of a striking apparatus are still required.

The striking apparatus itself is also varied in form, however all forms are complex mechanisms comprised of various materials including formed metal, springs, levers, chains, bearings, straps, plastics, fabrics, wood, etc.

In both the acoustic and electronic bass drum configurations, other considerations need to be taken into account in order to achieve a desired playing method. Springs and levers need to be tensioned properly to accept the mechanical leverage applied by the players' foot and also to return the pedal to its resting state. Beaters that strike the sounding and/or trigger apparatus need to be set at the correct striking height. Straps and chains need to be adjusted to shorten or lengthen the throw of beater against the sounding and/or trigger apparatus. In both cases, the striking apparatus also needs to be attached by a clamping device to the sounding and/or trigger apparatus. There are some electronic bass drum pedals that combine the striking and trigger apparatus into one device, however they are still designed as a pedal that is depressed activating the beater, which then strikes a trigger apparatus.

Attempts at improvements in the design of conventional drum foot pedals for use with electronic drum kits have been made as outlined by the following U.S. patents:

U.S. Pat. No. 6,979,770; Hampton, Jr. This design focuses on speed and increasing the number of triggered drumbeats and relies on a complex apparatus to achieve this.

U.S. Pat. Nos. 7,074,997 and 7,531,733 and 7,435,888; Steele. These designs focus again mainly on improving the speed of the foot pedal and increasing the number of beats triggered. It also again relies on a complex apparatus to achieve these results. In addition, a slightly new playing technique is required to be learned in order to use the pedal to it's full potential.

These prior art devices suffer from notable drawbacks particularly: large sizes, difficult to transport, depend on the interaction of two distinct and complex apparatuses and in some cases, require learning a new playing technique in order to utilize the device.

SUMMARY OF THE INVENTION

The present invention is a control device worn on the players' foot that has been modified into the simplest form of electronic bass drum pedal. This "footwear" combines the striking and trigger apparatus into one extremely portable and space saving device, can be used to trigger an infinite number of user defined sounds and requires no new technique in order to use. This device requires no moveable parts and therefore needs no mechanical adjustments or manufacturing of special components. The footwear contains a piezoelectric transducer in the heel area that when struck (using the traditional "heel-up" and/or "heel-down" bass drum pedal playing techniques) generates an electric signal that is sent to an electronic drum module producing a synthesized drum sound. A player simply wears the device on his/her foot, connects the device to a drum module and plays.

DETAILED DESCRIPTION OF THE INVENTION

Figure 1:
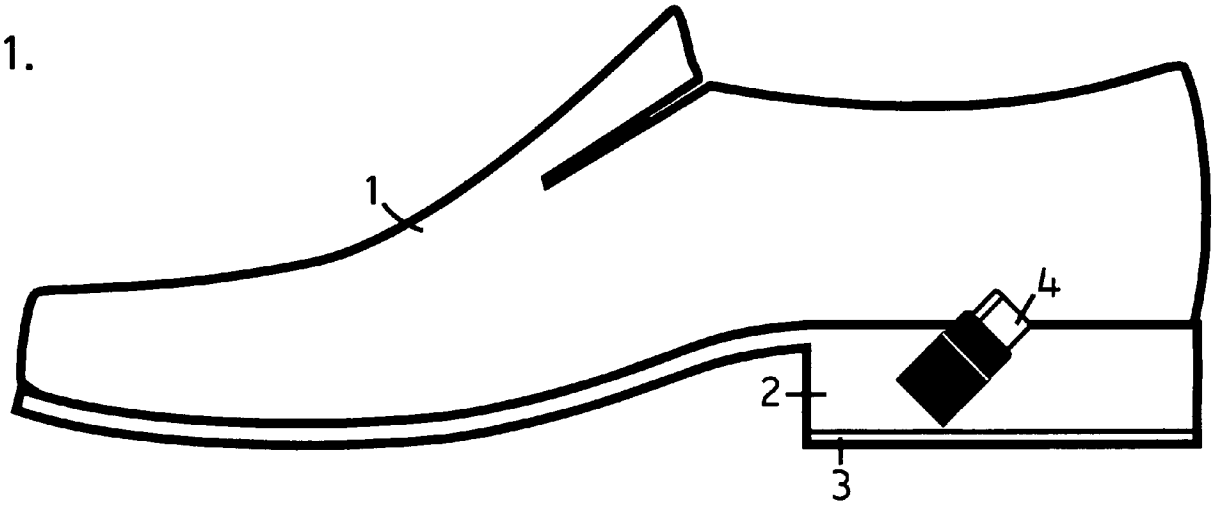
FIG. 1 is a side elevation of the present invention using a heeled left shoe as the control device.

In the embodiment of the invention illustrated, FIG. 1 is comprised of a heeled shoe 1, the shoe heel 2, the removable bottom portion of the heel 3, and a 90° RCA adapter jack 4.

Figure 2:
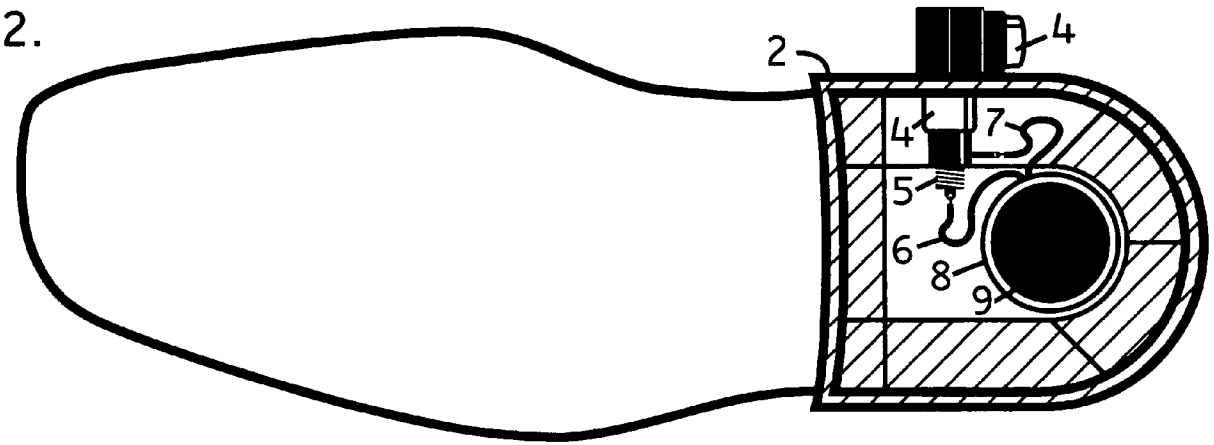
FIG. 2 is a bottom plan view with a cross-sectional view showing in detail the electronic components and their placement inside the heel of the device.

FIG. 2, refers more specifically to the interior of the heel 2, of which is comprised of a round piece of medium stiffness foam 9 which sits on top a 35 mm diameter piezoelectric transducer 8 which is wired via negative wire 7 and positive wire 6 to a female RCA jack 5 that is connected to the male input of the 90° RCA adapter jack 4.

A player simply wears the shoe 1 and using a ¼" jack to RCA jack cable (typically), connects the RCA end of that cable to the female end of the 90° RCA adapter jack 4 and the ¼" jack of the cable to a ¼" input of the drum module. In operation, a player wearing the device will tap the heel or toe (depending on the technique used) of the shoe against the floor surface in order to produce electrical signals that will travel from the piezoelectric transducer through the attached cable to the drum module to trigger a synthesized sound.

Most drum modules will have a few parameters to adjust in order to achieve the desired playing result. The most important of them is the sensitivity of the piezoelectric transducer. This parameter needs to be set at a level that will allow the player to move and adjust his foot normally without causing false triggers yet allow for the correct articulation of each heel tap that is supposed to trigger a drum sound. It is apparent that the above described device is susceptible to modification and variation without departing from the scope of the invention. For instance, a second piezotransducer 8 could be added to the toe of the shoe 1 with an additional 90° RCA adapter 4 in the heel 2 to allow for more rapid triggering of sounds. Other kinds of variations could include: different kinds of wearable heeled or unheeled footwear, other sizes or kinds of piezoelectric transducers, and inputs other than RCA. Therefore the invention is not deemed to be limited except as defined in the appended claims.

I claim:

1. A portable and foot-operated control device for triggering an electronic instrument comprising: a wearable device designed for the foot containing a housing unit integrated into the wearable device; at least one transducer for generating electronic signals which is housed inside the housing unit; and an electronic output jack wired to the transducer and attached to the housing unit of the device, by which the generated electronic signals will be transmitted to a sound producing module for processing and amplification.

2. The portable and foot-operated control device according to claim 1, wherein the wearable device is footwear.

3. The portable and foot-operated control device according to claim 1, wherein said primary housing unit within the heel of the wearable device.

4. The portable and foot-operated control device according to claim 1, wherein the at least one transducer is, or is based upon, a piezoelectric transducer.

5. The portable and foot-operated control device according to claim 1, wherein said wearable device has a removable portion which provides access to the housing unit.

* * * * *